US005842230A

United States Patent [19]

Laudick

[11] Patent Number: 5,842,230

[45] Date of Patent: Dec. 1, 1998

[54] HALTER TOP AND METHOD OF MAKING SAME

[76] Inventor: William P. Laudick, 3208 Henry, National City, Mich. 48748

[21] Appl. No.: 680,689

[22] Filed: Jul. 18, 1996

[51] Int. Cl.[6] ..... A41C 3/00; A41D 27/00

[52] U.S. Cl. ..... 2/69; 2/73; 2/106; 2/243.1; 2/227; 450/86; 450/92

[58] Field of Search ..... 2/46, 48, 51, 52, 2/69, 69.8, 73, 70, 71, 72, 79, 227, 243.1, 115, 113; 450/86, 88, 92, 60, 62

[56] References Cited

U.S. PATENT DOCUMENTS

| | | | |
|---|---|---|---|
| D. 95,575 | 5/1935 | Blood . | |
| D. 280,251 | 8/1985 | Forbes . | |
| 2,023,612 | 12/1935 | Park et al. | 450/88 |
| 2,378,908 | 6/1945 | Blum . | |
| 2,635,241 | 4/1953 | Graf . | |
| 2,817,089 | 12/1957 | Oelbaum | 450/86 |
| 3,062,216 | 11/1962 | Stein . | |
| 3,311,112 | 3/1967 | Murray | 450/88 |
| 3,491,762 | 1/1970 | Simonsen | 450/60 |
| 3,828,585 | 8/1974 | Thorneburg . | |
| 4,100,924 | 7/1978 | Rosenberg | 450/86 |
| 4,739,910 | 4/1988 | Westphal et al. . | |
| 5,116,278 | 5/1992 | Sroub et al. | 2/73 |

OTHER PUBLICATIONS

Summer Sale Catalog 1996, Frederick's of Hollywood.

*Primary Examiner*—Jeanette E. Chapman
*Attorney, Agent, or Firm*—Vanophem Meehan & Vanophem, P.C.

[57] ABSTRACT

A halter top made from recycling a pair of pants. The halter top embodies a body strap formed from the waistband of the pair of pants, a right and a left breast cup formed from the back pockets of the pair of pants, and connecting straps for holding the halter top in place formed from the seams of the pair of pants. The method of making the halter top involves detaching pieces of the pair of pants in nearly a single sequence and reassembling the pieces to form the top.

4 Claims, 3 Drawing Sheets

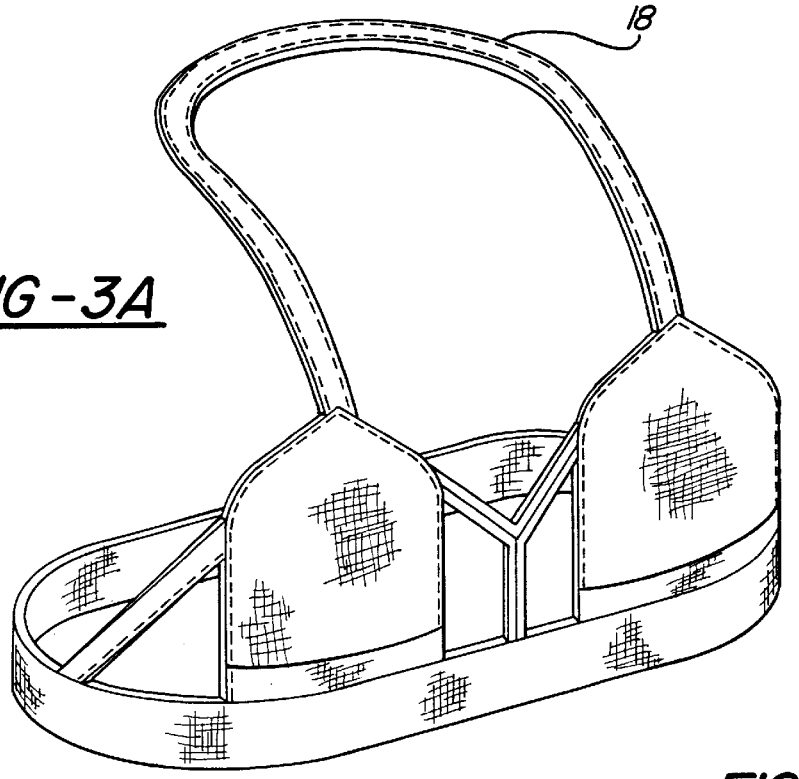
FIG-3A
FIG-4
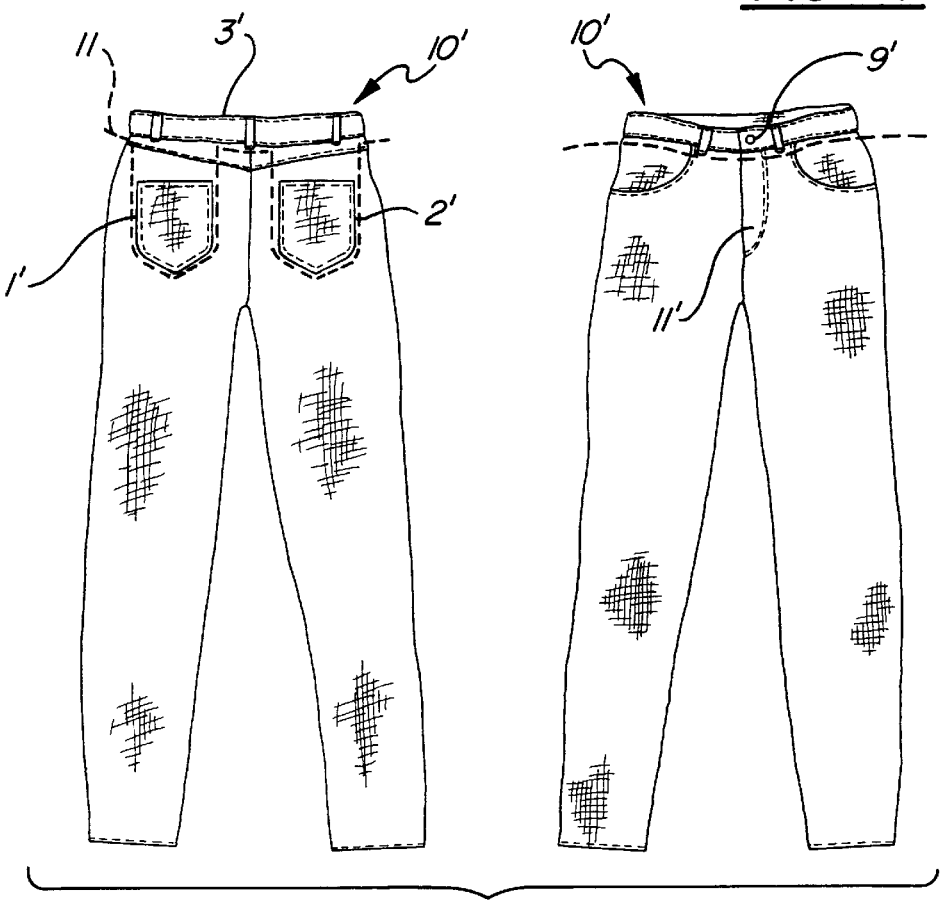

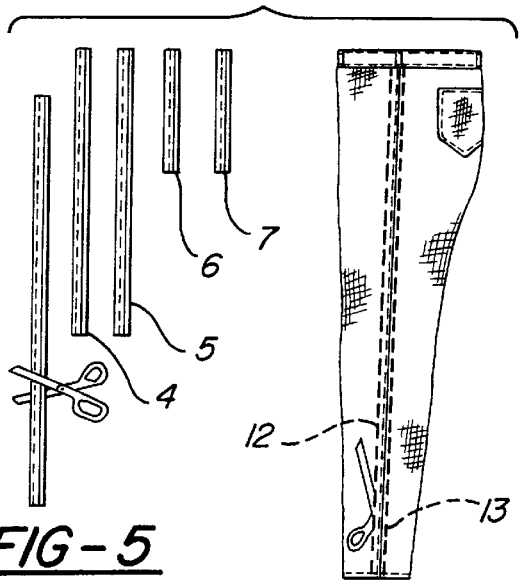
FIG-5
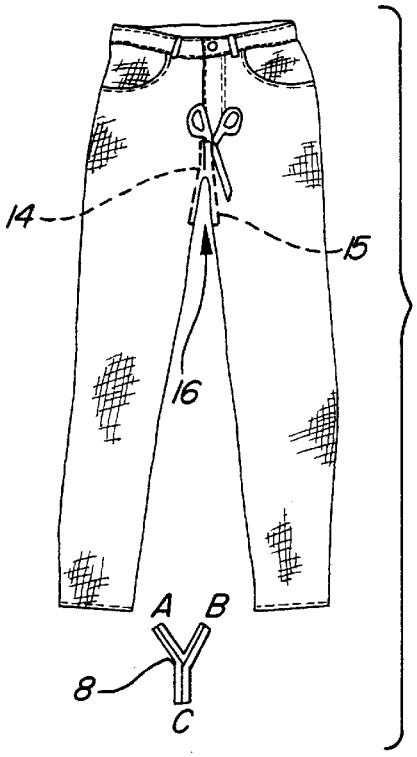
FIG-6
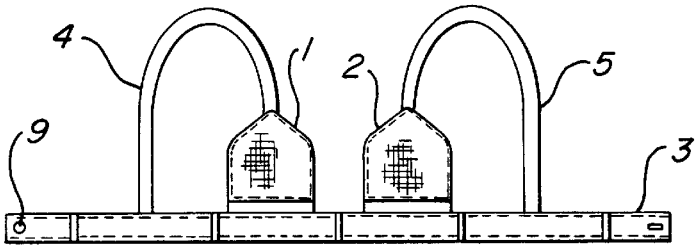
FIG-7
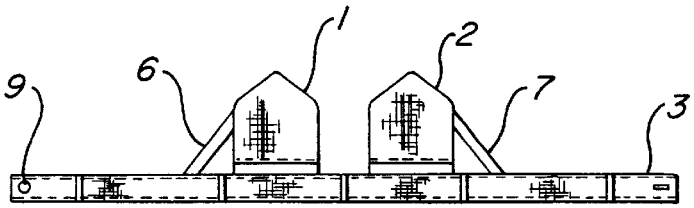
FIG-8
FIG-9
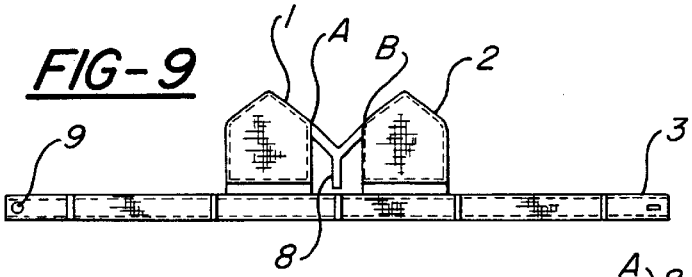
FIG-10
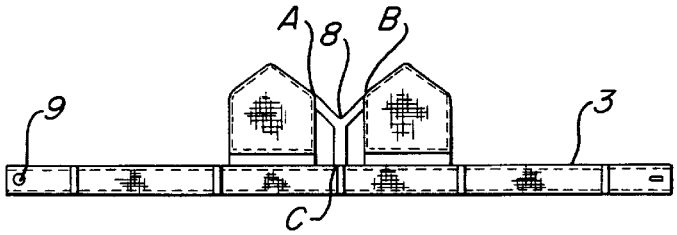

HALTER TOP AND METHOD OF MAKING SAME

BACKGROUND OF THE INVENTION

1. Field of the Invention

The present invention relates to articles of clothing and in particular to a halter top. More particularly, the present invention relates to a halter top and a method of making a halter top from a pair of pants.

2. Description of the Prior Art

Reducing waste and recycling articles is a major concern for the environment. When an item that would have been discarded can be recycled into useful and purposeful items and at the same time provide a unique and fashionable article of clothing, two objectives are simultaneously accomplished.

It is well known in the art to provide a garment for supporting and covering the breasts to improve the wearer's comfort and appearance. It is also well known in the art to recycle some articles of clothing into certain objects. For example, it is well known to recycle denim jeans into other articles, such as seat cushions, handbags or quilts.

Clothing fashions are constantly changing. As a result of these constant changes, there is a continuing desire for exciting, new and different articles of clothing. But at the same time, there is a need to keep clothing affordable.

Thus, there is a need to develop new and simple methods of manufacturing, as well as find inexpensive sources for material.

There is also a need to develop purposeful objects from recycled items.

SUMMARY OF THE INVENTION

The novel features of the present invention relate to creating a garment for covering and supporting the breasts, commonly referred to as a brassiere or a halter top, from a pair of pants. The halter top is trimmed from the pants in nearly a single sequence. Connecting straps are also formed from material removed from the pants and attached in a configuration such that the former back pockets from the pants now make-up the cups of the halter top or brassiere and cover the wearer's breasts. The former waistband from the pants now surrounds the chest of the wearer with the waistband fastening in the posterior of the torso.

The method according to the present invention involves using the waistband and the back pocket portion of a pair of pants in conjunction with portions of the seams of the pants to make the halter top. The method preferably includes the steps of trimming around the waistband and back pockets of the pants and removing the seams of the pant legs to form connecting straps. The method also includes removing a portion of the seam of the crotch area of the pants to form connecting straps in a "Y" configuration for holding the halter top in place. The "Y" configuration provides attachment of the connecting straps to the former waistband and former back pockets of the pants between the breasts, holding the former back pockets in place a fixed distance apart.

The waistband and back pockets remain as originally attached on the pair of pants. The shoulder and side straps are trimmed to a desired length from the seam of the pants. The shoulder and side straps are attached to support and hold the halter top on the wearer. The new halter top is positioned on the torso so that the former back pockets of the pants now make-up the cups of the halter top and cover the breasts and chest area of the wearer. The former waistband of the pants now surrounds the torso and fastens in the posterior of the torso. The connecting straps formed from the seams of the pant legs now traverse the shoulders of the wearer and extend between the former back pockets and the former waistband.

In the preferred embodiment of the present invention, a pair of denim pants is used to make the halter top. However, any type of pant or short pants with back pockets would be suitable. In addition, any material forming a halter top such that the breast cups resemble back pockets of a pair of pants and the body strap resembles a waistband from a pair of pants is also an embodiment of the present invention.

It is an object of the present invention to produce an article of clothing that is simple and inexpensive to make.

It is another object of the present invention to recycle used articles of clothing into new, useful, different and fashionable articles of clothing.

It is a further object of the present invention to construct a stylish halter top entirely out of pieces taken from a pair of pants.

Other advantages of the present invention will be more apparent from the following detailed description of the preferred embodiment taken in connection with the accompanying drawings.

BRIEF DESCRIPTION OF THE DRAWINGS

FIG. 3A is a side perspective of a halter top according to the present invention with a neck strap and a cup strap without connection to the body strap;

FIG. 4 is a diagram of the method of making a halter top's breast cups and body strap according to the present invention;

FIG. 5 is a diagram of the method of making a halter top's connecting straps according to the present invention;

FIG. 6 is a diagram of the method of making a halter top's cup strap according to the present invention;

FIG. 7 is a diagram of the method of assembling a halter top's shoulder straps according to the present invention;

FIG. 8 is a diagram of the method of assembling a halter top's side straps according to the present invention;

FIG. 9 is a diagram of the method of assembling a halter top's cup strap branches according to the present invention; and FIG. 10 is a diagram of the method of assembling a halter top's cup strap stem according to the present invention.

DETAILED DESCRIPTION OF THE PREFERRED EMBODIMENT

Figure 1:
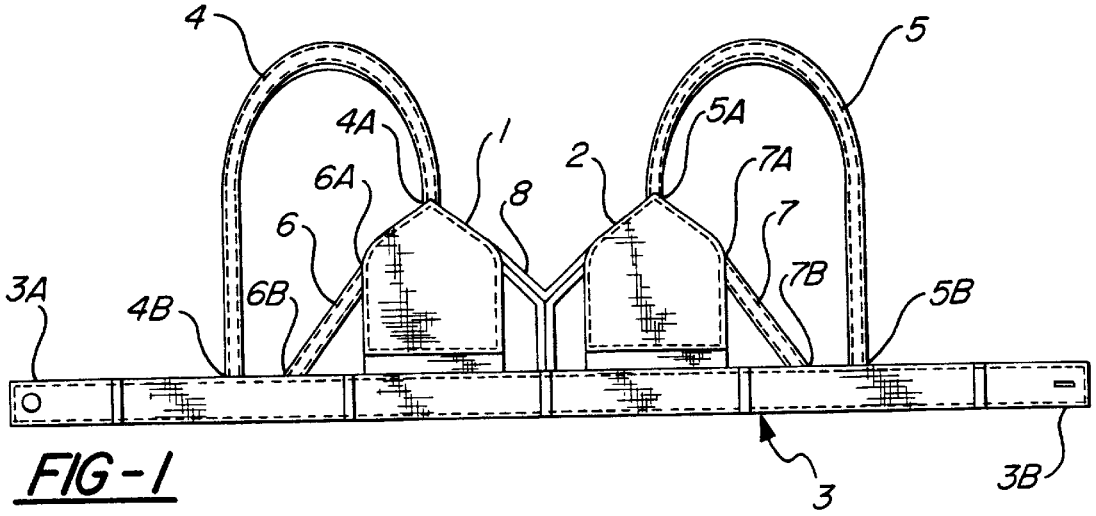
FIG. 1 is a front view of a halter top according to the present invention.
Figure 2:
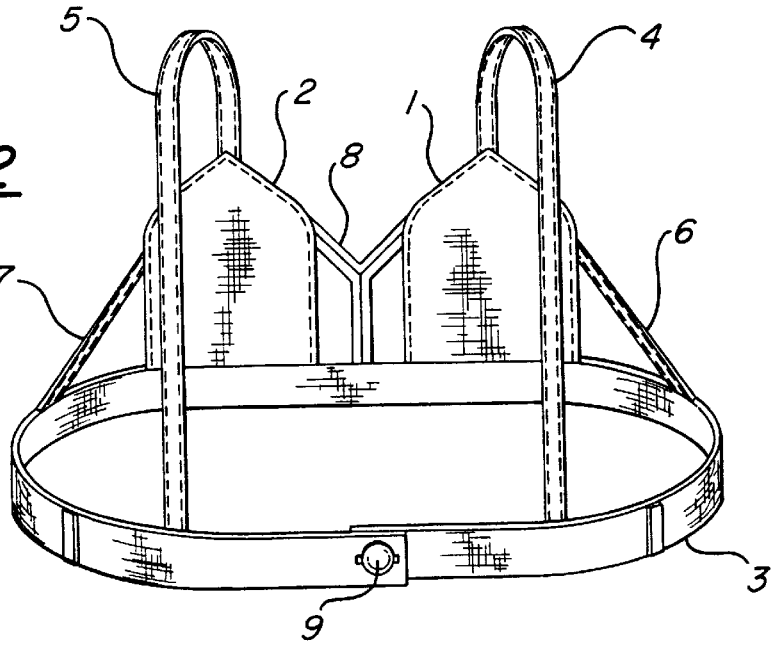
FIG. 2 is a rear view of a halter top according to the present invention.

A preferred embodiment of a halter top 10 constructed in accordance with the present invention is shown in FIG. 1 wherein the halter top 10 includes a right breast cup 1, a left breast cup 2, a body strap 3, connecting straps 4–7 and a cup strap 8. There are several configurations in which the connecting straps and cup strap can be attached to the halter top. The preferred embodiment has a connecting strap 4 for the right shoulder, a connecting strap 5 for the left shoulder, a right side connecting strap 6, a left side connecting strap 7, and a cup strap 8. The body strap 3 has a first end 3A and a second end 3B. The right and left shoulder straps 4 and 5 each have first ends 4A and 5A, and second ends 4B and 5B. The right and left side straps 6 and 7 each have first ends 6A and 7A, and second ends 6B and 7B.

Figure 3:
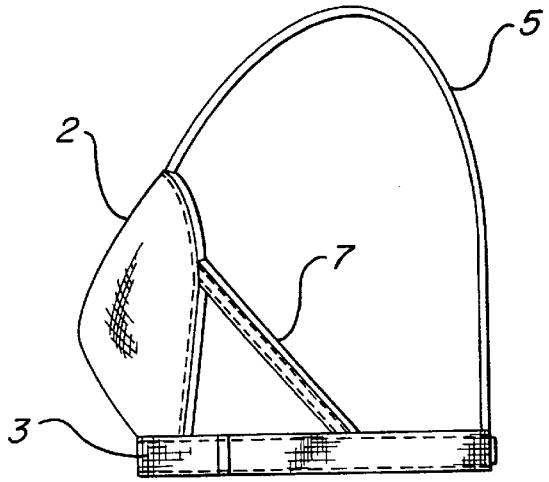
FIG. 3 is a side perspective of a halter top according to the present invention.

A further embodiment, shown in FIG. 3A, has a connecting strap 18 around the neck of the wearer. Each end of the neck strap 18 is connected to the top of the right and left breast cups 1 and 2.

The breast cups 1 and 2 are the former back pockets 1' and 2' from the posterior of a pair of pants 10' as shown in step 1 of FIG. 4. The breast cups 1 and 2 are intended to support and cover the wearer's breasts in a fashion similar to a brassiere. The back pocket portion from the former pants 10' is inverted and positioned over the chest in a manner covering the breasts of the wearer, similar to known halter tops and brassieres. The former back pockets 1' and 2' are now worn, on the anterior chest portion of the torso.

The body strap 3 is the former waistband 3' from the pair of pants 10', which functions to hold the top on the wearer's chest area of the torso. A fastener 9 connects the end 3A to the end 3B. The fastener 9 once held the pants in place around the waist as a fastener 9'. The waistband 3' and pockets 1' and 2' are now worn as a top resulting in the former pockets of the posterior of the pants and the former waistband being upside down and backward.

The halter top 10 is held in place on the torso not only by the body strap 3, but by the several connecting straps 4–7 and the cup strap 8 as well. All of the connecting straps are formed from the seams which have been removed from the former pair of pants 10'. The right and left shoulder straps 4 and 5, and the right and left side straps 6 and 7 have first ends A and second ends B. The first ends are connected to one of the breast cups 1 or 2, and the second ends are connected to the body strap 3.

The right shoulder strap 4 is formed from the former seams of the pant legs as shown in Step 2 of FIG. 5. The first end 4A of the right shoulder strap 4 is connected at or near the top of the right breast cup 1. The right shoulder strap 4 travels over the wearer's right shoulder and down the back of the wearer. The second end 4B of the right shoulder strap 4 is connected to the body strap 3 in the posterior of the torso. The right shoulder strap 4 supports the halter top 10 in place on the wearer by hanging from the right shoulder The left shoulder strap 5 is also formed from the former seams of the pant legs also shown in Step 2 of FIG. 5. The first end 5A of the left shoulder strap 5 is connected at or near the top of the left breast cup 2. The left shoulder strap 5 travels over the wearer's left shoulder and down the back of the wearer. The second end 5B of the left shoulder strap 5 is connected to the body strap 3 in the posterior of the torso. The left shoulder strap 5 supports the halter top 10 in place on the wearer by hanging from the left shoulder.

The right and left shoulder straps 4 and 5 are similar to the shoulder straps of known halter tops and brassieres.

In addition to the right and left shoulder straps 4 and 5, the right side strap 6 and the left side strap 7 provide additional support for maintaining the top 10 in position on the wearer's torso. The right and left side straps 6 ant 7 are also preferably formed from the seams of the pant legs as shown in Step 2 of FIG. 5. The right and left side straps 6 and 7 are attached between the sides of the breast cups 1 and 2 and the body strap 3 to assist in holding the halter top 10 in place on the torso and at the same time holding the right and left breast cups 1 and 2 in place on the breasts.

The first end 6A of the right side strap 6 is attached to the right breast cup 1 on the right side of the right breast cup 1. The second end 6B of the right side strap 6 is attached to the body strap 3 near the posterior of the torso on the wearer's right side.

The first end 7A of the left side strap 7 is attached at the left breast cup 2 on the left side of the left breast cup 2. The second end 7B of the left side strap 7 is attached to the body strap 3 near the posterior of the torso on the wearer's left side.

Finally, the breast cups 1 and 2 themselves are held a fixed distance apart from each other by a cup strap 8. The cup strap has two branches A and B and a stem C, all having a first end and a second end. The first ends of each of the two branches A and B are connected to the breast cups 1 and 2. The second ends of the two branches A and B are connected together. The first end of the stem C is connected to the joined second ends of the two branches A and B. Finally, the second end of the stem C is connected to the body strap 3. The cup strap 8 is preferably formed from the seam of the crotch of the pants as shown in FIG. 6.

As would be obvious to one skilled in the art, the stem C of the cup strap could be eliminated and the breast cups 1 and 2 are held together without any connection to the body strap 3 in between the breast cups 1 and 2.

A method of manufacturing the above described halter top 10 preferably includes removing the necessary pieces from a pair of pants as indicated above. In one embodiment the halter top is made from denim jeans, but any type of pant or short pants with back pockets would be suitable as will become apparent in the following description. The method is shown in flow diagram form in FIGS. 4–10.

Begin removing the waistband and back pockets of the pants by any means such as cutting, along line 11, as shown in FIG. 4, which separates the waistband and back pockets from a pair of pants. It is best to start in the front of the pants just below the waistband 3' as shown in FIG. 4, at the fly or zipper 11'. Following line 11 along the waistband 3' removes the right pant leg and right front pocket from the pants. Continuing along line 11 around the right side of the waistband detaches the right side of the pant leg.

When line 11 reaches the right back pocket 1', it preferably follows the outline of the back pocket 1'. In the preferred embodiment, the right back pocket 1' remains attached to the waistband 3'. After following up and around the right back pocket 1', continue down the left side of the right back pocket to the waistband in between the right and left back pocket 1' and 2'.

Maintain the path along line 11 and continue along the waistband 3' between the back pockets 1' and 2'. Line 11 continues up and along the sides of the left back pocket 2', which remains intact with the waistband 3'. After following the outline of the left back pocket 2', removal along line 11 continues back to the waistband 3' where the left pant leg is completely severed from the waistband along the left side of the pants. The pant leg scraps should be reserved as material for the connecting straps. The fly or zipper, front pockets and pant legs have all been detached.

Next, the connecting straps preferably are formed directly from the pants. However, it is possible to use any other suitable material. The connecting straps may be formed from the seam of the pant leg, as shown in FIG. 5. Removal of the seam follows along lines 12 and 13.

The shoulder straps, 4 and 5, are formed from the seam of the pant leg by removing the seam along lines 12 and 13 shown in FIG. 5. The shoulder straps 4 and 5 should be long enough to traverse the shoulder of a wearer beginning at the anterior of the torso just above the breast and ending just under the shoulder blade in the posterior of the torso.

Referring to FIG. 5, the side straps 6 and 7, are also preferably formed from the seam of the pant legs by following along lines 12 and 13. The side straps 6 and 7 should be long enough to attach the first ends 6A and 7A of the side straps 6 and 7 to the outer sides of breast cups 1 and 2 respectively, and the second ends 6B and 7B of the side straps 6 and 7 to the body strap 3 at a point preferably under the wearer's arm.

The cup strap 8 may be formed from the seam of the pant legs by removing the seam along lines 12 and 13, or from the crotch area by removing the seam along lines 14, 15, and 16 as shown in FIG. 6. The seam removed from the crotch area is in a "Y" configuration. This allows attachment between the right and left breast cups 1 and 2 with each branch of the "Y", and at the same time provides attachment to the body strap 3 with the stem of the "Y" as shown in FIG. 6. The cup strap 8 holds the breast cups 1 and 2 at a fixed distance from each other, and provides additional support by attaching to the body strap 3 as well.

Assembly of the halter top 10 using the pieces removed from the pants is shown in FIGS. 7–10. The right shoulder strap 4 and left shoulder strap 5 assembly is shown in FIG. 7. The right side strap 6 and left side strap 7 assembly is shown in FIG. 8. The cup strap 8 assembly is shown in FIGS. 9 and 10.

Assembly of the halter top begins by attaching the first end 4A of the right shoulder strap 4 to the top of the right breast cup 1. The second end 4B of the right shoulder strap 4 is attached to the body strap 3 in the posterior of the torso, near the fastener 9. This procedure is repeated with the left breast cup 2 and left shoulder strap 5. When the right and left shoulder straps 4 and 5 are in place, the halter top 10 is held in place on the torso by hanging from the shoulders of the wearer.

The first end 6A of the right side strap 6 is attached to the outer side of the right breast cup 1. The second end 6B of the right side strap 6 is attached to the body strap 3 near the posterior of the torso. This procedure is repeated with the left breast cup 2 and the left side strap 7. The right and left side straps 6 and 7 are located under the arms along the outer sides of the torso. When the halter top 10 is on the torso, hanging from the shoulders, the right and left side straps 6 and 7 will provide additional support along the sides of the wearer and prevent the breast cups 1 and 2 from being displaced from the breasts of the wearer, and also provide a novel and unique look.

Finally, the cup strap 8 is attached to the front of the halter top between the breast cups. The cup strap 8 is in a "Y" configuration as best shown in FIG. 6. The first end of branch A is attached to the inner side of the right breast cup 1. The first end of branch B is attached to the inner side of the left breast cup 2. The second end of stem C is attached to the body strap 3 between the right and left breast cups 1 and 2.

While the invention has been set forth and described in terms of a preferred embodiment, it is apparent that other forms of the present invention can be adopted by one skilled in the art. Accordingly, the scope of the present invention is limited only by the following claims.

What is claimed is:

1. A method of making a top from a pair of pants having a waistband, a first pocket and a second pocket, said top having a body strap, a right breast cup, a left breast cup, and means for holding said top in place on a wearer, said method comprising the steps of:

removing said waistband from said pair of pants to constitute said body strap of said top;

removing said first and second pockets of said pair of pants attaching said first and second pockets of said pair of pants to said body strap of said top to constitute right and left breast cups of said top; and attaching a plurality of connecting straps to said right and left breast cups of said top.

2. A method of making a top from a pair of pants as set forth in claim 1 wherein said plurality of connecting straps are attached between said right and left breast cups.

3. The method as set forth in claim 1 further comprising the steps of:

removing a seam from a pant leg of said pair of pants to constitute right and left shoulder straps for said top, and attaching said right and left shoulder straps between said right and left breast cups respectively and said body strap; and removing a seam from a pant leg of said pair of pants to constitute a side strap for said top, and attaching said side strap between said breast cup and said body strap along a side of said wearer.

4. The method as set forth in claim 2, further comprising the steps of removing the seam from the crotch of said pair of pants to constitute a cup strap, said cup strap in the form of a "Y" shape, said "Y" shape having a first end, a second end and a third end;

attaching said first end of said cup strap to said right breast cup of said top;

attaching said second end of said cup strap to said left breast cup; and attaching said third end of said cup strap to said body strap between said right and left breast cups.

* * * * *